United States Patent [19]

Eckert et al.

[11] Patent Number: 4,790,263

[45] Date of Patent: Dec. 13, 1988

[54] PROCESS FOR APPLICATION OF FREE-FLOWING MATERIAL ON THE INNER SURFACE OF A TUBE BLANK AND DEVICE FOR PERFORMING THE PROCESS

[75] Inventors: Beat Eckert, Olten; Guido Huber, Baar; Norbert Richle, Remetschwil, all of Switzerland

[73] Assignee: Lonza, Ltd., Gampel, Switzerland

[21] Appl. No.: 66,523

[22] Filed: Jun. 26, 1987

[30] Foreign Application Priority Data

Jul. 3, 1986 [CH] Switzerland ..... 02682/86

[51] Int. Cl.[4] ..... B05B 1/02

[52] U.S. Cl. ..... 118/317; 427/181; 427/236; 239/400; 239/403

[58] Field of Search ..... 427/181, 183, 236; 118/317, 318; 239/403, 400; 51/411

[56] References Cited

U.S. PATENT DOCUMENTS

| | | | |
|---|---|---|---|
| 679,756 | 8/1901 | Kennedy | 51/411 X |
| 998,762 | 7/1911 | Faller | 239/403 |
| 4,055,025 | 10/1977 | Seese et al. | 51/411 |
| 4,090,666 | 5/1978 | Peck | 118/629 X |
| 4,452,169 | 6/1984 | Matsuda | 51/411 X |
| 4,454,173 | 6/1984 | Koga | 427/181 X |
| 4,668,534 | 5/1987 | Gray | 118/318 X |

FOREIGN PATENT DOCUMENTS

| | | | |
|---|---|---|---|
| 295268 | 3/1966 | Australia | 427/182 |
| 0133937 | 3/1985 | European Pat. Off. . | |

*Primary Examiner*—Shrive Beck

*Attorney, Agent, or Firm*—Fisher, Christen & Sabol

[57] ABSTRACT

The material is applied to the inner surface by means of a carrier gas stream, provided with a swirl, conducted through the hollow space. To prevent or reduce the swirl loss, which occurs if the laden carrier gas stream, provided with the swirl, forces the stagnant air in the hollow space from this space and then the loss develops by friction on the inner surface, before and during the flow of the laden carrier gas provided with the swirl, an additional gas, not laden with the material, is conducted through the hollow space with a siwrl, whose direction of rotation corresponds to the swirl of the laden carrier gas stream. For this purpose, the device has on the outlet of a passage element (1), equipped with a swirl-producing device 3 for the laden carrier gas stream, outlet nozzles (4), which feed to the laden carrier gas stream the additional gas with a swirl, whose direction of rotation corresponds to that (5) of the swirl-producing device.

8 Claims, 1 Drawing Sheet

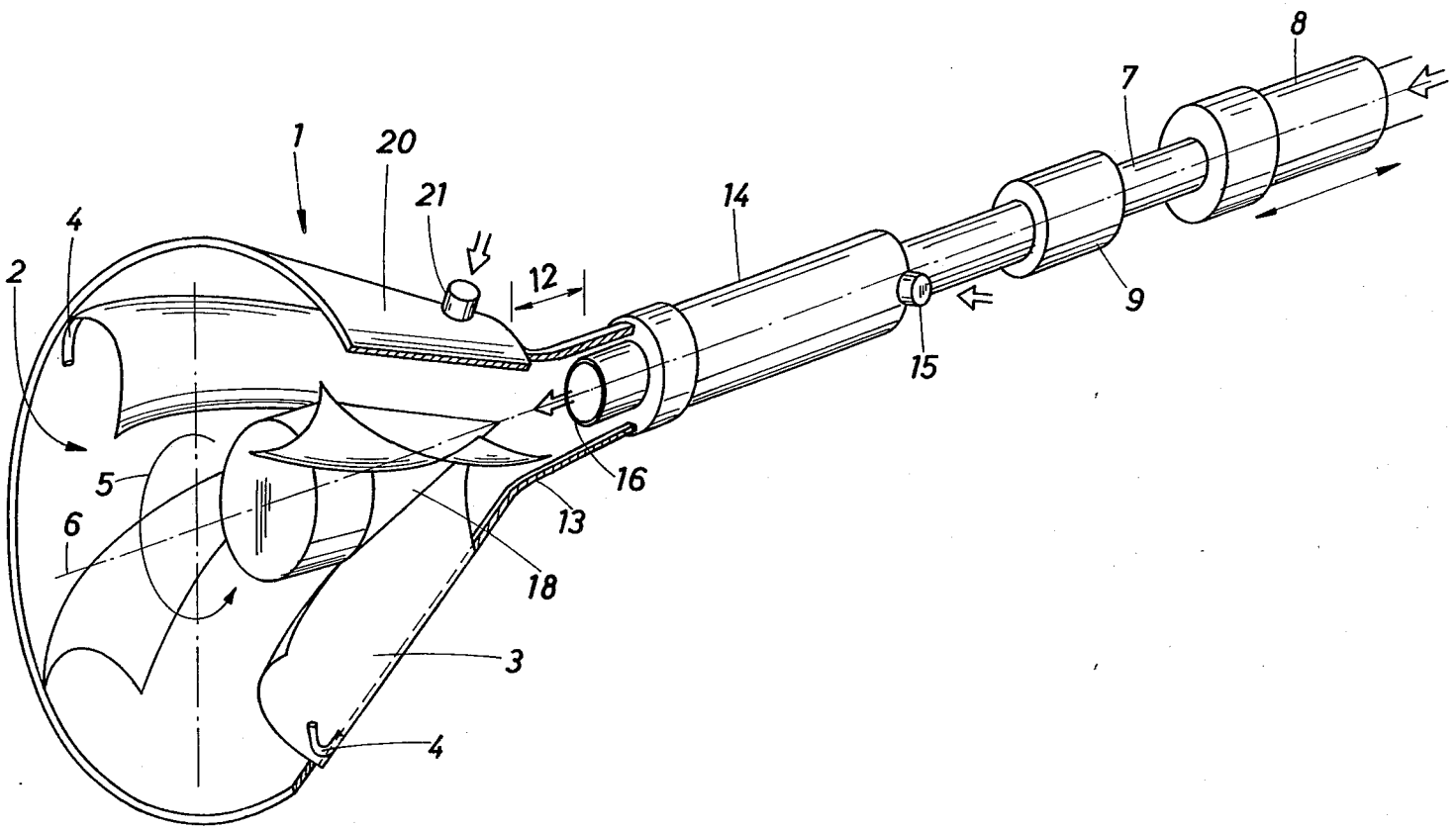
8
7
9
15
14
16
13
18
3
4
12
21
20
1
5
6
4
2

PROCESS FOR APPLICATION OF FREE-FLOWING MATERIAL ON THE INNER SURFACE OF A TUBE BLANK AND DEVICE FOR PERFORMING THE PROCESS

BACKGROUND OF THE INVENTION

1. Field of the Invention

The invention relates to a process for application of a free-flowing material on the inner surface of a tube blank and to a device for performing the process.

2. Background Art

A process is known for descaling the inner surface of red-hot hollow billets in the production of seamless tubes. In such process for application of a free-flowing material to the inner surface of a tube blank with a continuous, at least approximately cylindrical hollow space, a carrier gas stream laden with the material is conducted axially through the hollow space after imparting of a swirl. The device for performance of the process has a passage element for the carrier gas stream laden with the material, in whose passage space a swirl-producing device is placed. See European Published Application No. 0133937.

In such process and with such device, the carrier gas stream laden with the material, namely, a descaling agent, is conducted with the swirl directly through the tube blank, namely, the red-hot hollow billet. Thus, by means of the swirl, a more uniform distribution of the material in the carrier gas is achieved and, by the centrifugal force resulting from the swirl, a considerable part of the material is brought to the inner surface of the tube blank, without obeying the forces of gravity.

The laden carrier gas stream with the swirl must first drive the stagnant air in the hollow space through and from the hollow space. Thus, a part of its swirl is transferred to the stagnant air and is lost for the applying of the material to the inner surface of the tube blank. When the laden carrier gas stream flows through the hollow space its speed and its swirl are smaller near the inner surface than in the center of the hollow space cross section. The flow becomes laminar because of the friction on the inner surface, especially if the surface, e.g., in he case of a hollow billet, is coarsely covered with a layer of scale. Altogether only a part of the swirl imparted to the laden carrier gas stream is effective in applying the material to the inner surface.

BROAD DESCRIPTION OF THE INVENTION

The invention provides a remedy for such prior art problems. The invention achieves the object, which is to improve the process and device of the prior art type mentioned above, to apply to the inner surface of the tube blank a considerable part of the material with which the carrier gas stream, to which a swirl is imparted, is laden.

In this case, swirl is to be understood in the sense of a helical movement or a helical line movement.

The advantages attained by the invention are basically seen in the fact that the laden carrier gas stream with the swirl on penetrating into the hollow space does not strike the stagnant air but the additional unladen gas stream, which already flows through the hollow space in the same direction and with a swirl of the same direction of rotation as the laden carrier gas stream. As a result, the laden carrier stream immediately acts with its entire speed and the entire swirl imparted to it for application of the material to the inner surface from one end of the hollow space to the other. If the additional gas stream is continued for at least a part of the duration of the laden carrier gas stream, during this time the loss of speed and swirl caused by friction of the laden carrier gas stream on the inner surface can be offset by the action of the additional gas stream so that altogether a swirl takes effect, which can be identical, but also greater (or also smaller) than the swirl imparted to the carrier gas stream depending on the speed and swirl of the additional gas stream. By the additional gas stream being fed into the hollow space on one or, in partial streams, on several evenly distributed points on the periphery of the hollow space, the additional gas stream works only close to the inner surface of the hollow space. Altogether the effectiveness of the above-described known process or of the above-described known device is considerably improved by the invention. Other advantages and advantageous embodiments of the invention are seen from the following description of a way of embodying the invention.

Depending upon the type of material, the material of the tube blank or the use of the process or the use of the device, both the carrier gas and the additional gas, which is not laden with the material, can be air or another, especially inert, gas or a gas mixture and need not be identical, especially the one first with the material and only later together with the material and the other first alone and optionally later together with the carrier gas-material mixture comes in contact with the inner surface of the hollow space (in the case of a red-hot hollow billet). Also the other gas can be or can contain a liquid in gas phase or an aerosol.

Depending upon the use of the process or use of the device, the free-flowing material can be a semifluid, a paste, a molten or particle-shaped material, such as, powder, granular material, short fibers or chips, a liquid or a mixture of such materials.

The gas stream containing the carrier gas and the additional gas as well as a residue of the material and that leaving the hollow space can be exhausted to support the stream in the hollow space, in which the residue of the material, if it consists of fine particles, can be separated in a separator for further use.

BRIEF DESCRIPTION OF THE DRAWING

The invention is explained in detail below by means of the attached drawing, which represents the preferred method of embodiment. In the drawing, the FIGURE shows a perspective view of a partially-sectioned device for performance of the process for application of a free-flowing material on the inner surface of a tube blank, whose hollow space is continuous and at least approximately cylindrical.

DETAILED DESCRIPTION OF THE INVENTION

The invention device is especially suitable for the use of the invention process for application of a free-flowing descaling agent to the inner surface of hollow billets in the production of seamless tubes. The essential part of the device in connection with the invention is passage element 1 for a carrier gas stream laden with the material. In passage space 2 of passage element 1 are placed guide vanes 3 which form a swirl-producing device for the laden carrier gas stream. According to the invention, passage element 1 is provided with a feed device, in the FIGURE with nozzles 4 for an additional gas not laden with the material, whose outflow directions are arranged skewed to the axis of passage space 2 to impart to this gas a swirl with rotation direction 5 of the swirl-producing device formed by guide vanes 3. In the FIGURE this is a righthanded swirl. Nozzles 4 can be made as Laval nozzles.

Feed pipe 7 for the laden carrier gas, together with passage element 1, is guided by shifting unit 8 with a sliding travel of, e.g., 40 cm and a flexible sleeve 9, which make it possible to introduce passage element 1 into the hollow space, center the element in relation to the space and to withdraw it again.

Passage element 1 is made conical as a diffuser. However, for hollow spaces of smaller diameter, a cylindrical design is suitable. Between the end (mouthpiece 16) of feed pipe 7 and the input of passage element 1 on the periphery there is gap 12 of, e.g., 15 to 35, preferably 20 to 30, mm in length, as a result of which in jet apparatus (jet pumps, atomizers) the known effect is attained which causes a better distribution of the material in the carrier gas stream leaving the passage element. If entry of air to the laden carrier gas stream is not desired, an annular space with gas feed surrounding the gap, closed outward, can be provided. Leading pipes 13 run along gap 12 to nozzles 4, pipes which are connected to a part of cylinders 14 surrounding feed pipe 7, a part which has a connection 15 for feeding of additional gas.

In passage space 2 a conically widened displacement body 18 is placed in the flow direction, in the case of the diffuser a diffuser cone, which is hollow and open at both ends, to support the known action in jet apparatus.

Passage element 1 or the diffuser has a double jacket 20 with feed pipe 21 and a discharge pipe (not shown) for cooling water, and displacement body 18 or diffuser cone is made hollow to hold down heating by heat radiation of the red-hot hollow billet. For this reason, guide vanes 3 are connected, e.g., welded, to the cooled jacket in a way that radiates heat as much as possible.

Guide vanes 3 are trough-shaped in cross section and curved in their longitudinal direction so that the hollow side of each of these curves is in the direction of the direction of rotation 5 of the produced swirl. The radius of curvature of the trough-shaped profile increases in the flow direction, corresponding to the increase of the diameter of the conical diffuser. With a cylindrical passage element the guide vanes can be spiral-like (without curves).

Guide vanes 3 can deviate from the embodiment in the FIGURE at the outlet of the passage element, e.g., have ends projecting 5 cm (not shown), whose width in the flow direction so decreases that the guide vane ring is conically tapered in the area of these ends to grip the tube blank in its hollow space when passage element 1 is introduced and to center the blank in relation to the space.

Nozzles 4 for feeding of the additional gas, not laden with the material, are placed at the output of passage element 1 each on the end of guide vane 3 so skewed in relation to axis 6 of passage space 2 that the swirl angle (which a tangent laid on helical line corresponding to the swirl forms with the axis of the helical line) is greater (the angle of inclination of this helical line is thus smaller) than the swirl angle (or angle of inclination) of the swirl of the carrier gas stream laden with the material.

In a conically widened passage element (diffuser 1), three to six, preferably four, guide vanes can be provided; in a cylindrical passage element four to twelve, preferably six to ten, guide vanes can be provided. Nozzle 4 is suitably placed on the end of every other guide vane 3. The angle on the apex of the cone of displacement body (or diffuser cone) 18 can be 35 degrees for a hollow space diameter of 15 to 20 cm, 30 degrees for smaller hollow space diameters and 40 degrees for greater hollow space diameters. In the case of conically widened displacement body (diffuser cone) 1, the angle on this apex of the cone can be identical with that of displacement body 18. With the use of the device for descaling of hollow billets, the inside diameter of mouthpiece 16 on the end of feed pipe 7 for the laden carrier gas stream is suitably 10 mm, if per billet 100 to 150 grams of powdered descaling agent is used, or up to 30 mm, if in each case about 400 grams of descaling agent is used.

For matching hollow spaces of different diameters passage elements 1 of different sizes, also with different swirl angles, especially conical passage elements for larger diameters and cylindrical passage elements for small diameters can optionally be fastened individually to the end piece of pipe 7 for the laden carrier gas stream.

According to the process, for example for descaling of the inner surface of red-hot hollow billets for the production of seamless tubes, 4 to 12 meters long with an inside diameter of 10 to 35 cm, the red-hot hollow billet is brought to the device so that the billet hollow space is sufficiently coaxial to the passage space of the passage element. Then the device, by actuation of shifting unit 8, is brought close to the hollow space and centered if necessary, and sleeve 9 gives way and optionally the conically tapered guide vane ring (not shown) is guided into the hollow space as the centering means. Then at first, air, not laden with the descaling agent, is fed with a pressure of, for example, 6 bars to connection 14 and blown into the hollow space by nozzles 4. Thus, two helical line streams, axially offset from one another, of this air are produced in the hollow space. After 0.5 to 3 seconds an amount of air of 15 to 20 liters (corresponding to 90 to 120 liters at normal pressure), laden with the descaling agent, is fed to feed pipe 7 at a pressure of, e.g., 6 bars, a swirl is imparted to it in passage space 2 of passage element 1, a swirl with which it flows through the hollow space with the unladen air stream. The swirl angle of the two air streams is suitable all the greater, the greater the diameter of the hollow space of the billet. This angle can be 30 to 60 degress for diameters of 10 to 35 cm. After the amount of air laden with the descaling agent has flown through the hollow space, the feeding of the unladen air is interrupted and the device is pulled back by means of shifting unit 8. After that, the next hollow billet can be descaled.

What is claimed is:

1. A device for application of a free-flowing material to the inner surface of a tube blank with a continuous, at least approximately cylindrical hollow space, comprising: feeding means for a continuous carrier gas flow laden with the material; a passage element (1) providing a passage space (2) for the laden carrier gas flow having an inlet end and an outlet end; said feeding means including a feed pipe (7) for the laden carrier gas flow having an outlet mouthpiece (16) directed to the inlet end of the passage space (2); guide vanes (3) placed in the passage space (2) between the inlet and outlet ends thereof and forming a swirl producing device for the laden carrier gas stream; the outlet end of the passage space (2) being adapted to axially direct to the hollow space of the tube blank the laden gas flow provided with its swirl; several jets (4) situated near the outlet end of the passage space (2) distributed evenly on its periphery, each being suitably fastened on one of the guide vanes (3); means (13) for feeding to the jets (4) a continuous gas stream which is not laden with the material; and the jet or jets (4) being skewed in relation to the axis (6) of the passage space (2) of the passage element (1) for producing at least one gas flow flowing helically at the inner surface of the hollow space of the tube blank and having the same direction of rotation as the swirl of the laden gas flow.

2. The device according to claim 1 wherein the guide vanes (3) for producing a swirl within the laden carrier gas stream further include ends projecting from the outlet of the passage element (1), the width of said ends decreasing towards the end of said passage space (2) so that the guide vane ring is conically tapered in the area of these ends to serve as centering means engageable in the hollow space of the tube blank for centering of the passage element in relation to this hollow space.

3. The device according to claim 1, wherein said passage space (2) is approximately conical in shape to allow for the positioning of a diffuser within said passage space.

4. The device according to claim 3, further including a hollow displacement body or diffuser cone (18), said cone (18), being open at both ends, said cone (18) being placed within the passage space (2) of the passage element (1) such that the diameter of said cone (18) widens outwardly in the same direction as said passage space (2) of passage element (1).

5. The device according to claim 1, wherein said passage element (1) comprises a doubled-walled jacket (20) for constraining a coolant or heat-carrying medium.

6. The device according to claim 1, wherein said jets (4) are several Laval nozzles, said Laval nozzles evenly disposed on the periphery of said outlet end of the passage element.

7. The device of claim 1, wherein the guide vanes (3) are placed in the passage space (2) in such a way that the guide vanes (3) form a swirl angle along the length of the passage space (2) relative to the axis (6) of the passage space (2), said guide vanes (3) being curved and trough-shaped, with the radius of curvature increasing in the direction of the flow of air along the passage space (2), the hollow side of said troughs disposed in the direction of rotation (5) of the swirl, whereby said swirl angle increases in the direction of the air flow along said passage space (2).

8. The device according to claim 1, wherein said passage element (1) is spaced apart from the outlet mouthpiece (16) of the feed pipe (7), thereby providing a jet apparatus.

* * * * *